US008713878B2

(12) United States Patent
Dolby et al.

(10) Patent No.: US 8,713,878 B2
(45) Date of Patent: May 6, 2014

(54) SEALANT JOINT BACKER SUPPORT

(75) Inventors: Jeffrey Scott Dolby, Buford, GA (US); Gregory Blake McKenna, Cumming, GA (US)

(73) Assignee: Alcoa Inc., Pittsburgh, PA (US)

( * ) Notice: Subject to any disclaimer, the term of this patent is extended or adjusted under 35 U.S.C. 154(b) by 238 days.

(21) Appl. No.: 13/150,572

(22) Filed: Jun. 1, 2011

(65) Prior Publication Data

US 2011/0298185 A1 Dec. 8, 2011

Related U.S. Application Data

(60) Provisional application No. 61/351,439, filed on Jun. 4, 2010.

(51) Int. Cl.
*E04B 1/686* (2006.01)

(52) U.S. Cl.
USPC ..... 52/396.03; 52/235; 52/395; 52/741.4

(58) Field of Classification Search
USPC ..... 52/235, 741.4, 395, 396.03; 277/630, 277/637
See application file for complete search history.

(56) References Cited

U.S. PATENT DOCUMENTS

| | | | | |
|---|---|---|---|---|
| 3,308,726 | A * | 3/1967 | Dreher | 404/67 |
| 3,866,374 | A * | 2/1975 | Dallen | 52/204.597 |
| 4,074,501 | A * | 2/1978 | Sandqvist | 52/741.4 |
| 4,899,508 | A * | 2/1990 | Biebuyck | 52/235 |
| 4,905,435 | A * | 3/1990 | Horst | 52/235 |
| 4,924,647 | A * | 5/1990 | Drucker | 52/235 |
| 4,924,650 | A * | 5/1990 | Dalluge | 52/741.4 |
| 5,205,091 | A * | 4/1993 | Brown | 52/126.6 |
| 5,263,292 | A * | 11/1993 | Holland et al. | 52/235 |
| 5,893,245 | A * | 4/1999 | Sekiguchi et al. | 52/235 |
| 7,707,796 | B2 * | 5/2010 | Arias | 52/745.09 |
| 7,752,818 | B1 * | 7/2010 | Roegge et al. | 52/235 |
| 7,797,899 | B2 * | 9/2010 | Linn et al. | 52/465 |
| 8,132,380 | B2 * | 3/2012 | Wilkes, Jr. | 52/396.04 |
| 8,347,569 | B1 * | 1/2013 | McIntyre et al. | 52/235 |
| 2009/0145070 | A1 * | 6/2009 | Linn et al. | 52/465 |
| 2010/0058696 | A1 * | 3/2010 | Mills | 52/396.05 |

FOREIGN PATENT DOCUMENTS

| | | | | |
|---|---|---|---|---|
| EP | 194435 | A2 * | 9/1986 | E04B 7/18 |
| GB | 2143570 | A * | 2/1985 | E06B 3/62 |

* cited by examiner

*Primary Examiner* — Joshua J Michener
*Assistant Examiner* — Matthew Gitlin
(74) *Attorney, Agent, or Firm* — Greenberg Traurig, LLP

(57) ABSTRACT

The present invention relates to a sealant joint backer support that can be used to prevent three-sided adhesion at a joint when an exterior weather seal is applied. In an embodiment, a bond breaker backer support of the present invention includes a resiliently flexible front face having a groove, wherein the groove is configured for adjusting the bond breaker backer support after installation; and a pair of resiliently flexible legs extending, respectively, from a first end and a second end of the flexible front face.

7 Claims, 3 Drawing Sheets

SEALANT JOINT BACKER SUPPORT

RELATED APPLICATIONS

This application claims the benefit of U.S. Provisional Application Ser. No. 61/351,439, filed Jun. 4, 2010, the entirety of this application is hereby incorporated herein by reference for the teachings therein.

BACKGROUND

A bond breaker serves to ensure that the bottom of a sealant is bond free, thereby allowing the sealant to adhere only to the sides of a joint. The type of bond breaker used for a given application will vary depending on the situation. The most common type of bond breaker is a soft rod that can be squeezed to fit inside the joint cavity. This rod serves as a bond breaker as well as a backing material. To serve as a bond breaker the rod must be made of a material, or have a surface coating of a material, to which the sealant will not adhere or have a surface so weak that it will break apart as the sealant moves. Thus, the bond breaker provides a back side to the joint that will not hinder movement. Typical bond breakers include polyethylene adhesive tape (or any strip of polyethylene), Teflon (most often in the form of tape), waxed rope, waxed paper, rolled paper, sand, weak polyurethane foam, polyethylene foam, a butyl rubber foam with a treated surface, wax pencil, grease, light petroleum jelly, oil, and anything else that satisfies the requirement that the material provides a back side to the sealant such that the sealant will not adhere to it.

SUMMARY

A sealant joint bond breaker is disclosed herein.

According to aspects illustrated herein, in an embodiment there is disclosed a bond breaker backer support that includes a resiliently flexible front face having a groove, wherein the groove is configured for adjusting the bond breaker backer support after installation; and a pair of resiliently flexible legs extending, respectively, from a first end of the flexible front face and a second end of the flexible front face.

According to aspects illustrated herein, in an embodiment there is disclosed an assembly that includes at least one retainer and at least one bond breaker backer support of the present invention, wherein the retainer fixes glass lites of an insulating glass unit (IGU) in place on both sides of a mullion (i.e., support two glass lites simultaneously) and wherein the bond breaker backer support provides a back side to a sealant such that the sealant will not adhere to the bond breaker backer support.

According to aspects illustrated herein, in an embodiment there is disclosed a curtain wall glazing system that includes at least two insulating glass units; at least one retainer for fixing glass lites of the insulating glass units in place on both sides of a mullion; and at least one bond breaker backer support for providing a back side to a sealant such that the sealant will not adhere to the bond breaker backer support.

BRIEF DESCRIPTION OF THE DRAWINGS

The present invention will be further explained with reference to the attached drawings, wherein like structures are referred to by like numerals throughout the several views. The drawings shown are not necessarily to scale, with emphasis instead generally being placed upon illustrating the principles of the present invention.

Figure 1A:
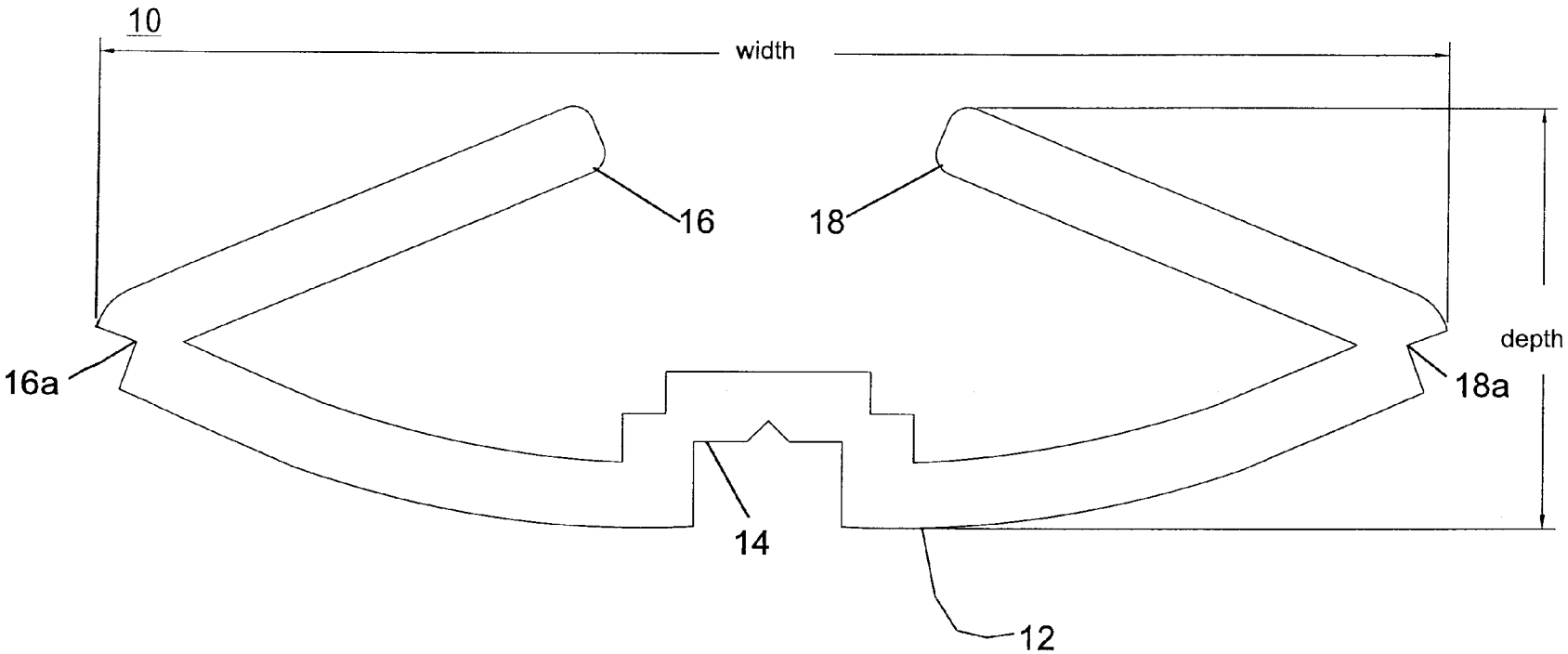
FIG. 1A illustrates an orthographic view of an embodiment of a bond breaker backer support of the present invention for use at a sealant joint.

While the above-identified drawings set forth presently disclosed embodiments, other embodiments are also contemplated, as noted in the discussion. This disclosure presents illustrative embodiments by way of representation and not limitation. Numerous other modifications and embodiments can be devised by those skilled in the art which fall within the scope and spirit of the principles of the present invention.

DETAILED DESCRIPTION

In an embodiment, a bond breaker backer support of the present invention is sufficiently designed and configured to create a backstop to allow proper sealant tooling at a sealant joint. In an embodiment, a bond breaker backer support of the present invention is sufficiently designed and configured to allow proper sealant wetting of sealant joint surfaces. In an embodiment, a bond breaker backer support of the present invention is sufficiently designed and configured to insulate the underside of a sealant at a sealant joint. In an embodiment, a bond breaker backer support of the present invention is sufficiently designed and configured to yield proper bond breaker between various components at a sealant joint. In an embodiment, a bond breaker backer support of the present invention is sufficiently designed and configured to prevent a sealant from bonding to various components at a sealant joint. In an embodiment, a bond breaker backer support of the present invention is sufficiently designed and configured to facilitate independent movement between various components of a sealant joint that would otherwise behave monolithically. In an embodiment, a bond breaker backer support of the present invention is sufficiently designed and configured to provide a back side to a joint that will not hinder movement. In an embodiment, a bond breaker backer support of the present invention can be used in the following applications, including, but not limited to, Glazing Operations, Window & Door Applications, Expansion Joints, Curtain Wall Joints, Partitions, Log Construction, Pavement Joints and Repairs, Precast Units & Copings.

A typical curtain wall includes a mullion structure in which mullions are fixed to a structural body of building, for example, such as concrete floor slab, steel framed truss or the like, transoms are stretched between adjacent mullions respectively, and panel members are mounted to a space defined by the adjacent two mullions and the transoms stretched therebetween. Such panel members are most often panes of glass, and often double pane glass sections, but other paneled building materials such as aluminum, granite, slate, or concrete are also utilized. Typically, once two adjoining panel members are secured in place, a backer rod is inserted, then joint sealant is applied between the panel members to seal against moisture and air penetration, to provide additional strength and stability to the panel members, and to provide a cushion allowing some movement by the panel members due to wind load, foundation settlement, earthquakes, hurricanes, and the like.

Some curtain wall systems utilize retainers or toggles to mechanically fasten the panel members to the mullion structure. Conventionally, the retainers intermittently interfere with the standard bond breaker backer rod application, and the backer rod must typically be cut into 6 inch to 9 inch long pieces to be located in between the retainers to back-up the exterior weather seals. Due to the backer rod being discontinuous, a gap is left at the retainers. The retainers then need to be covered by a different bond breaker, such as bond breaker tape, to prevent three-sided adhesion when the exterior weather seal is applied. Also, due to the backer rod being discontinuous, the ends of each backer rod piece can cause an uneven look in the exterior weather seal after the sealant has cured.

While illustrative embodiments of the present invention described herein show a toggle glazed curtain wall system that includes panel members with glass pane infills, it should be understood that a sealant joint bond breaker of the present invention can be used in other applications where the panel members include other infills made up of nearly any exterior building element, including, but not limited to, fabric, metals (such as aluminum, stainless steel, and composite metals), composite materials (such as fiber-reinforced plastic), ceramics (such as travertine), and masonry (such as calcium silicate, granite, marble, slate, travertine, limestone, concrete and brick).

Figure 1B:
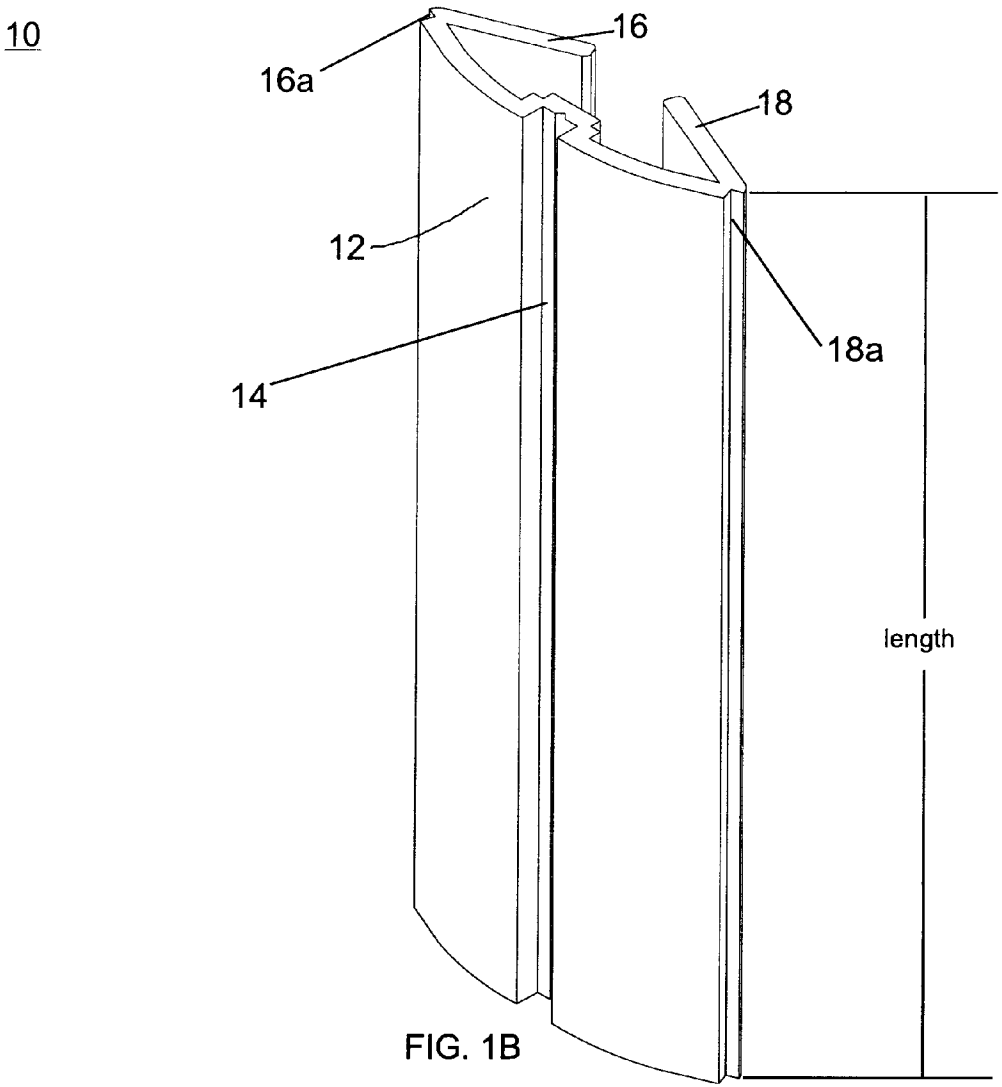
FIG. 1B illustrates a perspective view of the bond breaker backer support of FIG. 1A.

As illustrated in FIG. 1A in conjunction with FIG. 1B, an embodiment of a bond breaker backer support 10 of the present invention includes a resiliently flexible front face 12 having a groove 14 configured for adjusting the bond breaker backer support 10 after installation, and a pair of resiliently flexible legs 16 and 18 extending, respectively, from a first end 16*a* and a second end 18*a* of the flexible front face 12. In an embodiment, the first end 16*a* and the second end 18*a* are flexible hinges. The resiliently flexible legs 16 and 18 are configured for pushing the bond breaker backer support 10 forward after installation. In an embodiment, the flexible legs 16 and 18 are pushed forward after installation so that the flexible front face 12 becomes approximately flush with an edge of the outer glass lites of the insulating glass units. In an embodiment, the flexible front face 12 is comprised of a bond breaker non-stick material to ensure that only the two intended sides of the joint are adhered and prevent undesirable three-sided adhesion. In an embodiment, a pre-applied bond breaker top coat is applied to the material making up the flexible front face 12 to ensure that only the two intended sides of the joint are adhered and prevent undesirable three-sided adhesion. In an embodiment, the flexible front face 12 is fabricated from, or includes a top coat of, a polyethylene or similar type plastic. The width of the bond breaker backer support 10 may vary based on a given application. In an embodiment, the width of the bond breaker backer support 10 is between about 0.800 inches and about 1.000 inches. The depth of the bond breaker backer support 10 may vary based on a given application. In an embodiment, the depth of the bond breaker backer support 10 is between about 0.250 inches and about 0.350 inches. The length of the bond breaker backer support 10 may vary based on a given application. In an embodiment, the length of the bond breaker backer support 10 is about equal to the length of the insulating glass units, and is able to run multiple lites.

In an embodiment, at least a portion of the bond breaker backer support 10 is fabricated from a material that is flexible and corrosion-resistant, such as, for example, metals, elastomers, synthetic rubbers and polymers, and can be manufactured from a single material or multiple materials. In an embodiment, at least a portion of the bond breaker backer support 10 is fabricated from a polymer material, such as a homopolymer or a copolymer. In an embodiment, the polymer is polyethylene. In an embodiment, the polymer is polyurethane. In an embodiment, the polymer is a polyamide copolymer. In an embodiment, the polymer is a copolymer derived from acrylonitrile, butadiene, and styrene, for example, acrylonitrile butadiene styrene (ABS). In an embodiment, the polymer is a polyvinyl chloride homopolymer.

Figure 1C:
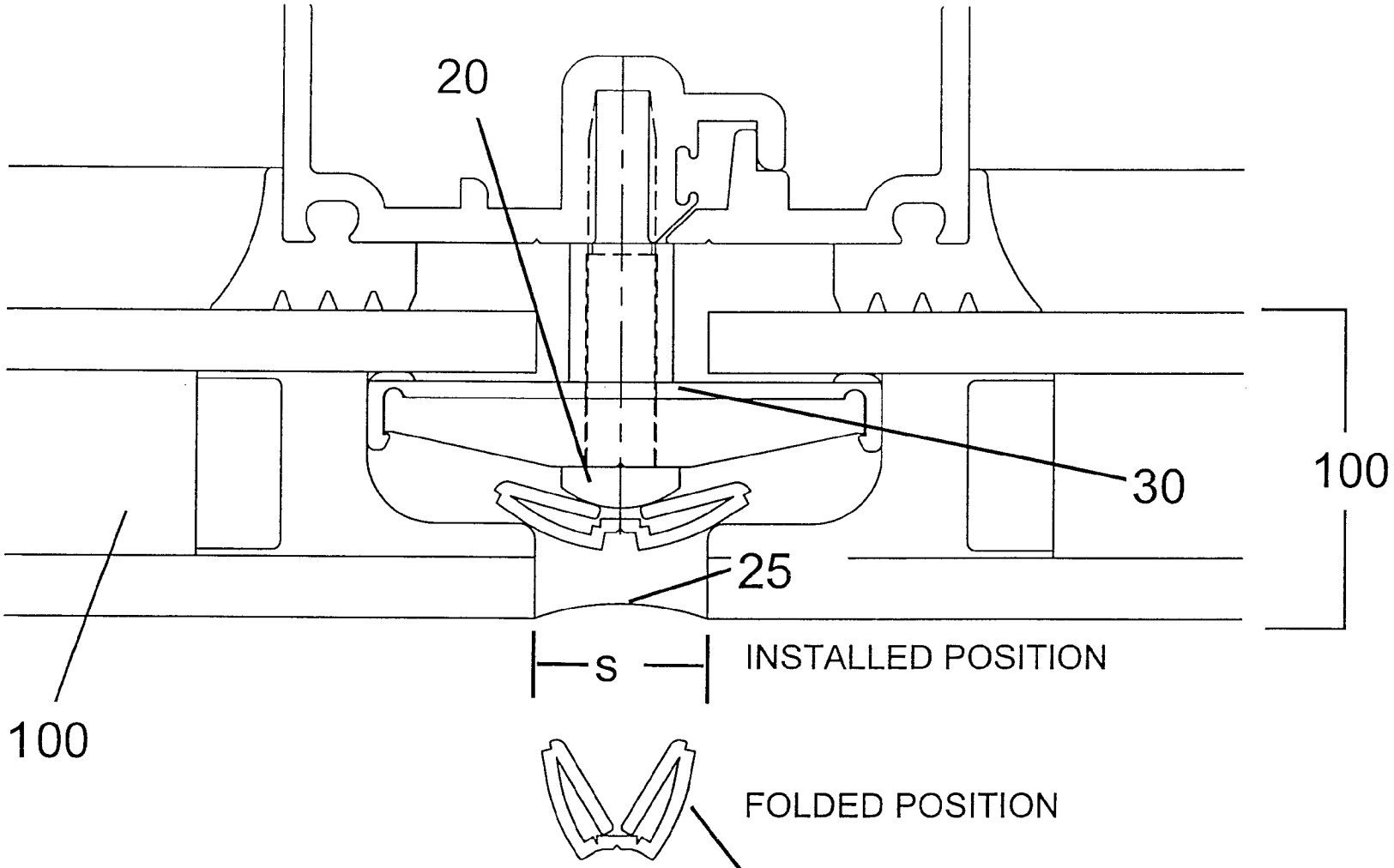
FIG. 1C illustrates a partial horizontal cut-away view of a toggle glazed curtain wall system according to an embodiment of the present invention, showing installation of a bond breaker backer support of the present invention at a sealant joint.

FIG. 1C illustrates a partial horizontal cut-away view of a toggle glazed curtain wall system according to an embodiment of the present invention, including a bond breaker backer support 10 of the present invention at a sealant joint 25. In an embodiment, during installation, the bond breaker backer support 10 is manually collapsed by squeezing the flexible front face 12 so that the first end 16*a* and the second end 18*a* flex and the flexible legs 16 and 18 fold towards each other, as illustrated in FIG. 1C. In the collapsed or folded position, the bond breaker backer support 10 is positioned through space "s" provided between two insulating glass units 100, slid into place over a fastener 20 that maintains a retainer 30, and then the bond breaker backer support 10 is expanded from the collapsed position. In an embodiment, the bond breaker backer support 10 rebounds back to its initial shape once it is in the installed position. In an embodiment, the retainer 30 is sufficiently designed to fix glass lites of an insulating glass unit (IGU) in place on both sides of a mullion. In an embodiment, the bond breaker backer support 10 covers the entire head of the fastener 20. The bond breaker backer support 10 can be adjusted after installation with a flat head screw driver at groove 14 to force the face 12 of the bond breaker backer support 10 towards the edge of the glass creating a continuous back-up for an exterior weather seal. In an embodiment, the bond breaker back support 10 can be cut to fit and butt spliced as needed. As illustrated in FIG. 1C, the flexible legs 16 and 18 of the bond breaker backer support 10 press up against the fastener 20. The bond breaker backer support 10 is sufficiently designed to be stiff enough to span the space "s" between the retainers 30 and still provide adequate support for the weather seal application.

While illustrative embodiments of the invention are disclosed herein, it will be appreciated that numerous modifications and other embodiments may be devised by those skilled in the art. Therefore, it will be understood that the appended claims are intended to cover all such modifications and embodiments that come within the spirit and scope of the present invention.

What is claimed is:

1. An assembly comprising:

at least one retainer, wherein the retainer fixes glass lites of an insulating glass unit (IGU) in place on both sides of a mullion; and at least one bond breaker backer support comprising:

a resiliently flexible front face having a groove; and a pair of resiliently flexible legs extending, respectively, from a first end of the flexible front face and a second end of the flexible front face, wherein the groove is configured for adjusting the bond breaker backer support after installation, and wherein the flexible front face is composed of a bond breaker non-stick material to which a sealant will not adhere, wherein the bond breaker backer support is positioned over the retainer to provide a continuous back-up for an exterior weather seal.

2. The assembly of claim 1 further comprising a fastener for maintaining the retainer.

3. The assembly of claim 1 wherein the bond breaker backer support has a width of between about 0.800 inches and about 1.000 inches.

4. The assembly of claim 1 wherein the bond breaker backer support has a depth of about 0.250 inches and about 0.350 inches.

5. The assembly of claim 1 wherein the bond breaker backer support is composed of a material that is flexible and corrosion-resistant.

6. The assembly of claim wherein the bond breaker backer support is composed of a material selected from the group consisting of metals, elastomers, synthetic rubbers and polymers.

7. The assembly of claim 1 wherein the groove of the bond breaker backer support runs along an entire length of the resiliently flexible front face.

* * * * *

UNITED STATES PATENT AND TRADEMARK OFFICE

CERTIFICATE OF CORRECTION

PATENT NO. : 8,713,878 B2
APPLICATION NO. : 13/150572
DATED : May 6, 2014
INVENTOR(S) : Jeffrey Scott Dolby et al.

It is certified that error appears in the above-identified patent and that said Letters Patent is hereby corrected as shown below:

In the Claims:

Col. 5, Ln. 10, Claim 6, insert --1-- after "The assembly of claim".

Signed and Sealed this
Fifth Day of August, 2014

Michelle K. Lee

Michelle K. Lee
*Deputy Director of the United States Patent and Trademark Office*